US006637680B1

(12) United States Patent
Young et al.

(10) Patent No.: US 6,637,680 B1
(45) Date of Patent: Oct. 28, 2003

(54) HORIZONTAL SHAFT IMPACT ROCK CRUSHER WITH BREAKER PLATE TENSION BAR LOCKING DEVICE

(75) Inventors: Gregory A. Young, Cedar Rapids, IA (US); Michael P. Stemper, Cedar Rapids, IA (US); Albert D. Botton, Marion, IA (US)

(73) Assignee: Cedarapids, Inc., Cedar Rapids, IA (US)

( * ) Notice: Subject to any disclaimer, the term of this patent is extended or adjusted under 35 U.S.C. 154(b) by 5 days.

(21) Appl. No.: 10/063,063

(22) Filed: Mar. 15, 2002

(51) Int. Cl.[7] ..... B02C 13/26

(52) U.S. Cl. ..... 241/30; 241/186.3; 241/189.1; 241/301

(58) Field of Search ..... 241/186.3, 186.2, 241/301, 189.1, 30

(56) References Cited

U.S. PATENT DOCUMENTS 6,070,819 A 6/2000 Young et al.
6,089,481 A 7/2000 Young
6,189,820 B1 2/2001 Young

OTHER PUBLICATIONS

The figure marked as Exhibit A shows a prior art system having a tension rod system and a short pivot shaft or pivot pin assembly.

Photocopy of a photo marked as Exhibit B, which shows a prior art locking nut with a hammer bar configuration as discussed in the background of the invention in application on file.

See figure marked as Exhibit C, which shows a prior art system where two secondary breaker plates share a pivot shaft.

Prior art system marked as Exhibit D shows a primary and secondary breaker plate sharing a pivot shaft.

*Primary Examiner*—Mark Rosenbaum
(74) *Attorney, Agent, or Firm*—Simmons, Perrine, Albright & Ellwood, P.L.C.

(57) ABSTRACT

A horizontal shaft impact rock crusher having breaker plates which are adjustable by hand, using a novel tension rod adjustment nut locking device which employs several loose-fitting retaining devices which, in combination with a bridge to a frame member or another tension rod, hold the tension rod adjustment nut in place.

20 Claims, 2 Drawing Sheets

HORIZONTAL SHAFT IMPACT ROCK CRUSHER WITH BREAKER PLATE TENSION BAR LOCKING DEVICE

BACKGROUND OF INVENTION

In the past, rock crusher designers have endeavored to improve the ease of operating and adjusting horizontal shaft impact rock crushers. While many improvements have been made to reduce the effort associated with adjusting such crushers, adjustment and locking of the tension bars for breaker plates on such crushers remains a non-trivial task. Most crushers usually have two breaker plates. A primary breaker plate is disposed nearest the feed opening and nearest the top of the crusher. These crushers typically have a secondary or rear breaker plate, which is generally located lower in the crusher and more toward the rear of the crusher. Both types of breaker plates typically employ one or more tension rods each to maintain the breaker plates at a set distance from the rotor of the crusher. Some attempt has been made to reduce unintentional changes in the setting for these breaker plates.

One example is the crusher shown in U.S. Pat. No. 6,089,481 entitled APPARATUS FOR RELIEVING THE LOAD ON ADJUSTING RODS OF A CRUSHER, issued to Gregory A. Young. This patent shows a lower adjusting nut and an upper locking nut disposed on a tension rod. In this design, a large torque is typically applied to the locking nut to prevent unintentional movement of the breaker plates. The necessary level of torque generally requires the use of a wrench. Other designs have been used to reduce unintentional breaker plate setting changes during operation, such as bar type nuts which permit the locking nut to be hammered upon until tight.

While these approaches of using double nuts, etc. have been used extensively in the past, they do have some drawbacks. First of all, they generally require the use of a wrench, hammer or other tool to make the necessary adjustment. Secondly, in the cases of the high torque requiring double nuts, there is often difficulty in achieving the necessary torque. Consequently, these nuts can often be undertightened, thereby allowing the breaker plate to self adjust.

Consequently, there exists a need for improved methods and systems for securely adjusting the setting of breaker plate adjusting tension rods in an efficient manner.

SUMMARY OF INVENTION

It is an object of the present invention to provide a system and method for adjusting a breaker plate setting in a horizontal shaft impact rock crusher in an efficient manner.

It is a feature of the present invention to utilize a nut rotation prevention device coupled with two nuts on a threaded tension rod.

It is an advantage of the present invention to achieve improved efficiency in adjusting the settings of breaker plates in horizontal shaft impact rock crushers.

It is another advantage to permit breaker plate locking nut adjustments to be made without requiring the use of locking nut-engaging tools.

The present invention is an apparatus and method for adjusting and securing the settings of breaker plates on horizontal shaft impact crushers, designed to satisfy the aforementioned needs, provide the previously stated objects, include the above-listed features, and achieve the already articulated advantages. The present invention is carried out in a "tool-less" manner in a sense that the need to use a wrench or other tool to unlock an adjusting nut for a breaker plate tension rod has been eliminated.

Accordingly, the present invention is a system and method including a horizontal shaft impact crusher having a breaker plate tension rod nut rotation prevention device coupled to two nuts on the tension rod.

BRIEF DESCRIPTION OF DRAWINGS

The invention may be more fully understood by reading the following description of the preferred embodiments of the invention, in conjunction with the appended drawings wherein.

DETAILED DESCRIPTION

Figure 1:
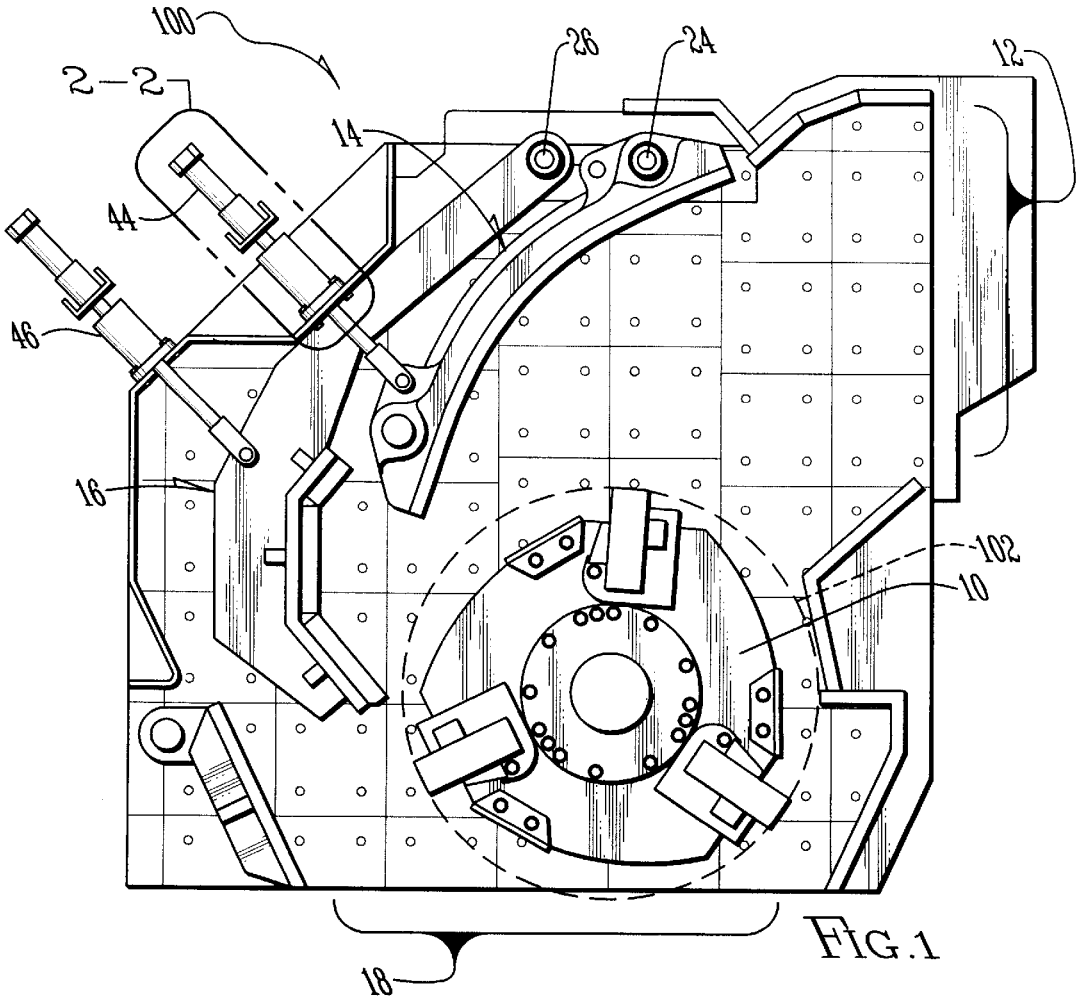
FIG. 1 is a schematic sectional view of a horizontal shaft impact crusher of the present invention, employing a novel breaker plate adjusting tension rod nut locking assembly.

Now referring to the drawings wherein like numerals refer to like matter throughout, and more specifically referring to FIG. 1, there is shown a rock crushing system of the present invention generally designated 100, including a horizontal shaft rotor 10, a feed opening 12, a primary breaker plate 14, a secondary breaker plate 16 and a discharge opening 18. Primary breaker plate 14 and secondary breaker plate 16 are coupled to the crusher 100 by primary breaker plate pivot shaft 24 and secondary breaker plate pivot shaft 26 respectively. Also shown in FIG. 1 are primary breaker plate adjusting tension rod assembly 44 and secondary breaker plate adjusting tension rod assembly 46, which are used to adjust the distance from rotor hammer circle 102 to primary breaker plate 14 and secondary breaker plate 16, respectively.

Figure 2:
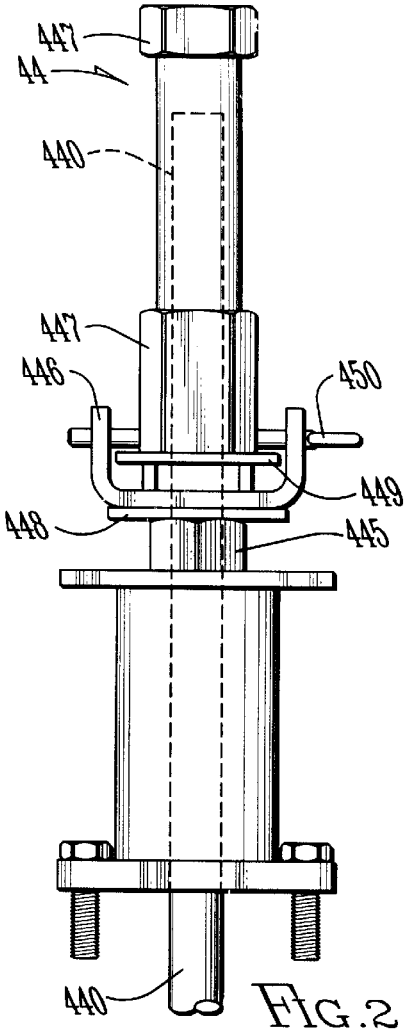
FIG. 2 is a close-up elevational view of a breaker plate adjusting tension rod assembly which is shown in the dashed lines of FIG. 1. The dashed lines in this figure show the underlying shaft.

A more detailed understanding of the present invention can be achieved by now referring to FIG. 2, which shows the primary breaker plate adjusting tension rod assembly 44 in a close-up side or elevational view. Primary breaker plate adjusting tension rod assembly 44 includes a primary breaker plate adjusting tension rod threaded shaft 440, which is shown with a dashed line because it is disposed out of sight, which extends through a bore in the crusher 100 and couples to primary breaker plate 14. Coupled to primary breaker plate adjusting tension rod threaded shaft 440 is primary breaker plate adjusting tension rod adjusting nut 445, which is used to set or limit the distance between the rotor 10 and the rotor hammer circle 102. Primary breaker plate adjusting tension rod bridge 446 is shown disposed above primary breaker plate adjusting tension rod adjusting nut 445. Primary breaker plate adjusting tension rod bridge 446 may be an elongated member extending between primary breaker plate adjusting tension rod assembly 44 and additional breaker plate adjusting tension rod assemblies (not shown) disposed a distance away from primary breaker plate adjusting tension rod assembly 44. Alternative primary breaker plate adjusting tension rod bridge 446 may be any member which couples to a portion of the crusher frame to prevent rotation of primary breaker plate adjusting tension rod bridge 446. Primary breaker plate adjusting tension rod bridge 446 is shown, in cross-section, as a channel, but it may take various shapes, such as a tube, a Z, or an angle, cross-section, or the like.

Primary breaker plate adjusting tension rod threaded shaft 440 has a primary breaker plate adjusting tension rod locking nut 447 disposed thereon and attached thereto, which is preferably elongated so as to be readily grasped by a human hand and to completely cover the end of shaft 440. Primary breaker plate adjusting tension rod locking nut 447 extends to meet with an inside portion of primary breaker plate adjusting tension rod bridge 446. Coupled to the bottom of primary breaker plate adjusting tension rod bridge 446 is breaker plate adjusting tension rod adjusting nut retainer 448, which can be any device having one or more internal surfaces which bear on primary breaker plate adjusting tension rod adjusting nut 445 so as to prevent it from rotating. Breaker plate adjusting tension rod adjusting nut retainer 448 can be fixed to primary breaker plate adjusting tension rod bridge 446 by any suitable means, such as bolts, pins, clamps, rivets, welding, etc. In applications where primary breaker plate adjusting tension rod bridge 446 couples to additional breaker plate adjusting tension rod assemblies, the requisite timing or adjusting nut alignment between the two or more assemblies can be finer, the more flat bearing surfaces there are on the primary breaker plate adjusting tension rod adjusting nut 445. The requisite timing may be even finer if the breaker plate adjusting tension rod adjusting nut retainer 448 has an internal pattern that matches two or more patterns of primary breaker plate adjusting tension rod adjusting nut 445.

Primary breaker plate adjusting tension rod locking nut 447 is used to hold primary breaker plate adjusting tension rod bridge 446 in place, so that breaker plate adjusting tension rod adjusting nut retainer 448 does not separate from primary breaker plate adjusting tension rod adjusting nut 445. However, due to the vibration of the crusher, primary breaker plate adjusting tension rod locking nut 447 would be susceptible to loosening if not otherwise restricted. Breaker plate adjusting tension rod locking nut retainer 449 is preferably a loose retainer that slips over primary breaker plate adjusting tension rod locking nut 447. Breaker plate adjusting tension rod locking nut retainer 449 bears, with one or more flat surfaces of its inside, against and prevents relative rotation with primary breaker plate adjusting tension rod locking nut 447 and bears, with its outside, against and prevents relative rotation with a leg or other portion of primary breaker plate adjusting tension rod bridge 446. The exterior shape of breaker plate adjusting tension rod locking nut retainer 449 may be rectangular or any shape which prevents it from rotating freely with respect to primary breaker plate adjusting tension rod bridge 446.

Breaker plate adjusting tension rod locking nut retainer 449 may be prevented from jumping out of engagement with primary breaker plate adjusting tension rod bridge 446 by any means, including clamps, pins, bolts, chains, cables, or other loose fastening devices. Locking nut retainer retaining pin 450 is one example of a device employed to prevent breaker plate adjusting tension rod locking nut retainer 449 from sliding so far up primary breaker plate adjusting tension rod locking nut 447 that breaker plate adjusting tension rod locking nut retainer 449 is above and, therefore, free of restrictive engagement with primary breaker plate adjusting tension rod bridge 446. Breaker plate adjusting tension rod locking nut retainer 449 need not be held tightly against primary breaker plate adjusting tension rod bridge 446 to prevent it from slipping over the top of primary breaker plate adjusting tension rod locking nut 447. Similarly, primary breaker plate adjusting tension rod locking nut 447 need not be held tightly against primary breaker plate adjusting tension rod bridge 446. It is sufficient that it (primary breaker plate adjusting tension rod locking nut 447) be close enough to primary breaker plate adjusting tension rod bridge 446 to prevent breaker plate adjusting tension rod adjusting nut retainer 448 from slipping off the primary breaker plate adjusting tension rod adjusting nut 445.

Figure 3:
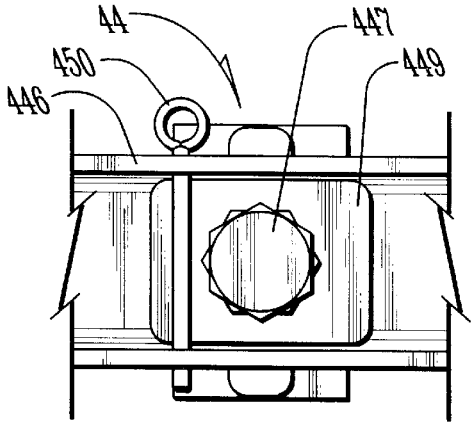
FIG. 3 is a close-up top view of the breaker plate adjusting tension rod assembly of FIG. 4.
Figure 4:
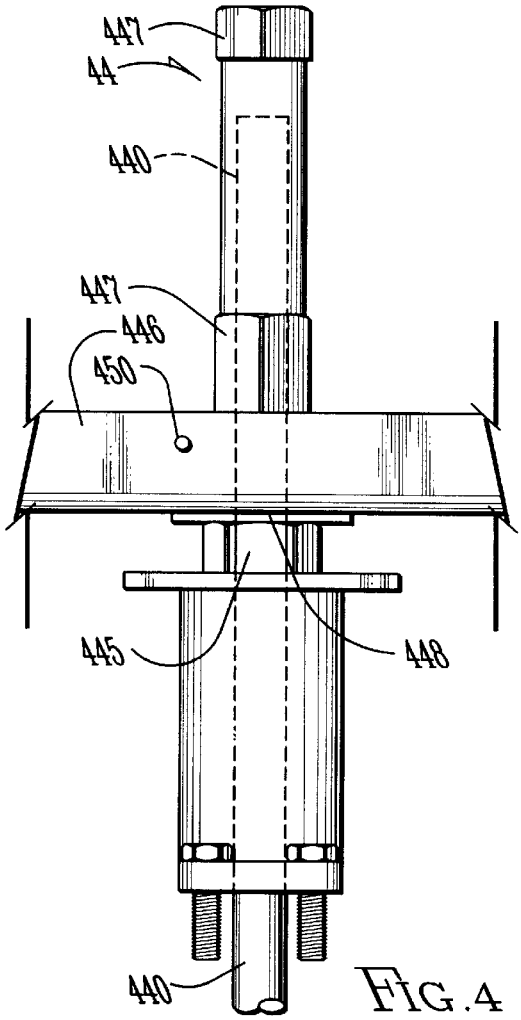
FIG. 4 is a close-up elevational view of the breaker plate adjusting tension rod assembly of FIG. 2 from an orthogonal direction with respect to FIG. 2. The dashed lines in this figure show the underlying shaft.

An even more detailed understanding of the present invention may be achieved by now referring to FIG. 3, which shows a close-up top or plan view of a portion of the primary breaker plate adjusting tension rod assembly 44 of FIG. 4, which clearly shows the relationship of primary breaker plate adjusting tension rod bridge 446 with respect to breaker plate adjusting tension rod locking nut retainer 449. It also shows clearly the orientation of a locking nut retainer retaining pin 450 with respect to breaker plate adjusting tension rod locking nut retainer 449 and primary breaker plate adjusting tension rod bridge 446.

FIG. 4 is another close-up side or elevational view of the primary breaker plate adjusting tension rod assembly 44 of FIG. 2 which is shown from an angle which is orthogonal to that of FIG. 2. Shaft 440 is shown with dashed lines, as it is disposed inside nut 447.

In operation, the apparatus and method of the present invention as described in

FIGS. 1–4, could function as follows to permit an adjustment of a primary breaker plate 14:

Firstly, primary breaker plate adjusting tension rod assembly 44 is configured as shown in FIGS. 1–4.

Secondly, the load or weight on the primary breaker plate adjusting tension rod nut 445 is reduced, in any appropriate manner, such as using a hydraulic assist system or tipping the crusher or a portion of it to reduce the weight.

Locking nut retainer retaining pin 450 is then removed by pulling it from an orifice in primary breaker plate adjusting tension rod bridge 446. Since breaker plate adjusting tension rod locking nut retainer 449 need not be held tightly against primary breaker plate adjusting tension rod bridge 446, locking nut retainer retaining pin 450 should be free to be removed without tools.

With locking nut retainer retaining pin 450 removed, breaker plate adjusting tension rod locking nut retainer 449 is slipped above primary breaker plate adjusting tension rod bridge 446, and the primary breaker plate adjusting tension rod locking nut 447 is loosened or retracted by hand by a distance greater than the effective height of breaker plate adjusting tension rod adjusting nut retainer 448, plus any amount that primary breaker plate adjusting tension rod adjusting nut 445 may need to be retracted. (This assumes the adjustment is not calling for primary breaker plate adjusting tension rod adjusting nut 445 to be advanced.)

Primary breaker plate adjusting tension rod bridge 446 and breaker plate adjusting tension rod adjusting nut retainer 448 are lifted off primary breaker plate adjusting tension rod adjusting nut 445.

Primary breaker plate adjusting tension rod adjusting nut 445 then is adjusted to a new position along primary breaker plate adjusting tension rod threaded shaft 440, thereby defining a new setting for primary breaker plate 14.

To secure the new setting, primary breaker plate adjusting tension rod adjusting nut 445 is aligned with a surface of breaker plate adjusting tension rod adjusting nut retainer 448, and primary breaker plate adjusting tension rod bridge 446 and breaker plate adjusting tension rod adjusting nut retainer 448 are slipped onto primary breaker plate adjusting tension rod adjusting nut 445.

Primary breaker plate adjusting tension rod locking nut 447 is advanced sufficiently close to primary breaker plate adjusting tension rod bridge 446 that breaker plate adjusting tension rod adjusting nut retainer 448 is not able to move beyond its effective placement with respect to primary breaker plate adjusting tension rod adjusting nut 445. (Note: this need not be a highly tight relationship. It should be sufficient to have primary breaker plate adjusting tension rod locking nut 447 merely touching, or even almost touching, primary breaker plate adjusting tension rod bridge 446.)

Breaker plate adjusting tension rod locking nut retainer 449 is then slipped down primary breaker plate adjusting tension rod locking nut 447 into primary breaker plate adjusting tension rod bridge 446 (assuming primary breaker plate adjusting tension rod locking nut 447 is properly aligned with respect to primary breaker plate adjusting tension rod bridge 446). This prevents primary breaker plate adjusting tension rod locking nut 447 from rotating with respect to primary breaker plate adjusting tension rod bridge 446.

Lastly, locking nut retainer retaining pin 450 is replaced to assure that breaker plate adjusting tension rod locking nut retainer 449 does not move a distance sufficient to be free from engagement with primary breaker plate adjusting tension rod bridge 446.

Following the above procedure, it is possible to adjust and re-secure at a new fixed position, primary breaker plate 14 without the use of tools.

Throughout this description, reference is made to primary breaker plates; however, it should be understood that the breaker plate adjusting tension rod assembly of the present invention is intended to be used with secondary and other breaker plates as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A rock crusher comprising:

a housing;

a rotor, disposed at least in part within said housing, said rotor having a substantially horizontal drive shaft;

said rotor configured for impacting material introduced into said housing;

a breaker plate disposed substantially in said housing;

a tension rod coupled to said breaker plate; an adjusting nut on said tension rod configured to limit movement of said breaker plate;

a second nut disposed on said tension rod distal of said breaker plate with respect to said adjusting nut;

a member disposed, at least in part, between said adjusting nut and said second nut, said member configured to engage and bear upon said adjusting nut and engage and bear against a retainer;

the retainer having an inside aperture and an outside surface, said retainer configured to bear, at said inside aperture, against and translate along said second nut; and, said member being coupled to, at least, a second point on said crusher so as to limit rotation of said member about said tension rod.

2. A rock crusher of claim 1 further comprising a means for retaining said retainer in operative alignment with said member.

3. A rock crusher of claim 2 wherein said means for retaining said retainer is a pin spanning two portions of said member, with a portion of said retainer being simultaneously disposed beneath said pin and above a portion of said member.

4. A rock crusher of claim 3 wherein a cross-section of said member comprises a substantially orthogonal L-shaped segment.

5. A rock crusher of claim 4 wherein the cross-section of said member comprises at least two L-shaped segments.

6. A rock crusher of claim 5 wherein the member has an elongated trough disposed therein along a longitudinal axis of said member.

7. A rock crusher of claim 6 wherein said retainer is disposed in said trough.

8. A rock crusher of claim 7 wherein said retainer is a flat, substantially rectangular spacer having at least one straight edge along said inside aperture.

9. A rock crusher of claim 8 wherein said member engages and bears upon said adjusting nut by providing a plurality of straight ridges on an underside of said member.

10. A method of adjusting settings of a breaker plate in a rock crusher comprising the steps of:

releasing a means for limiting displacement of a nut retainer;

displacing said nut retainer so as to no longer inhibit rotation of an outer nut;

retracting said outer nut, thereby increasing a distance between said outer nut and a lower nut retainer;

moving said lower nut retainer out of engagement with a lower nut; and, rotating the lower nut along a threaded tension rod, such that a breaker plate movement limit is defined.

11. A method of claim 10 further comprising the steps of:

placing the lower nut retainer into engagement with the lower nut;

advancing said outer nut toward said lower nut retainer;

placing said nut retainer so as to inhibit rotation of the outer nut; and engaging said means for limiting displacement of said nut retainer.

12. A tension rod nut locking apparatus for limiting movement of breaker plate in a horizontal shaft impact crusher, the nut locking apparatus comprising:

an elongated member having an underside and an upper side and a first tension rod receiving orifice;

said underside having at least one underside surface thereon configured to bear on an exterior nut surface of an adjusting nut;

a second nut;

said upper side having upper side structure configured to engage a retainer for the second nut;

the retainer configured to bear against said elongated member and the second nut, so that said second nut is inhibited from rotation by said elongated member; and said elongated member configured to couple with a rotation prevention structure disposed on a rock crusher.

13. An apparatus of claim 12 further comprising means for retaining said retainer in a close and non-fixedly bound position with respect to said elongated member.

14. An apparatus of claim 13 wherein said rotation prevention structure is a second tension rod of a rock crusher, and said elongated member is configured to couple with said second tension rod via a second orifice in said elongated member.

15. An apparatus of claim 12 wherein said underside of said elongated member is substantially co-planar with a top side of said adjusting nut, and said underside further having underside structure coupled thereto which is substantially orthogonal to said top side of said adjusting nut and is configured to bear on said adjusting nut.

16. An apparatus of claim 15 wherein said underside structure is a ridge.

17. An apparatus of claim 16 wherein said upper side structure is a structure disposed in a plane substantially orthogonal to said top side of said adjusting nut.

18. An apparatus of claim 17 wherein said retainer is a flat rectangular member having a central orifice therein with at least one linear edge.

19. An apparatus of claim 17 wherein:

said elongated member has a longitudinal axis and is a channel member having a substantially rectangular trough extending along said longitudinal axis;

the retainer is configured to drop inside said rectangular trough and be prevented from rotation by opposing parallel channel sides of said channel member;

said retainer is prevented from exiting said channel member by a pin extending across said rectangular trough and through said opposing parallel channel sides; and, wherein said second nut is an elongated nut with extended external sides sized and configured to be turned by grasping in a palm of a human hand.

20. An apparatus of claim 19 wherein said elongated member is configured to be coupled to a rock crusher at a fixed radial distance from an axis extending through a center of said adjusting nut.

* * * * *